US008760475B2

(12) United States Patent
Hsieh

(10) Patent No.: US 8,760,475 B2
(45) Date of Patent: Jun. 24, 2014

(54) METHOD OF DYNAMICALLY ADJUSTING SCREEN BRIGHTNESS

(75) Inventor: Yi-Chung Hsieh, Bade (TW)

(73) Assignee: Getac Technology Corporation, Hsinchu County (TW)

( * ) Notice: Subject to any disclaimer, the term of this patent is extended or adjusted under 35 U.S.C. 154(b) by 1770 days.

(21) Appl. No.: 11/958,869

(22) Filed: Dec. 18, 2007

(65) Prior Publication Data

US 2008/0291139 A1 Nov. 27, 2008

(30) Foreign Application Priority Data

May 25, 2007 (CN) ..... 2007 1 0028181

(51) Int. Cl.
*G09G 5/10* (2006.01)
*G09G 3/20* (2006.01)
*G09G 5/00* (2006.01)

(52) U.S. Cl.
CPC .. *G09G 5/00* (2013.01); *G09G 3/20* (2013.01); *G09G 2320/0626* (2013.01)
USPC ..... 345/690; 345/77; 345/102

(58) Field of Classification Search
USPC ..... 345/102
See application file for complete search history.

(56) References Cited

U.S. PATENT DOCUMENTS 5,554,912 A * 9/1996 Thayer et al. ..... 315/157
5,760,760 A * 6/1998 Helms ..... 345/102
7,567,245 B2 * 7/2009 Mamata ..... 345/207
2003/0122810 A1 * 7/2003 Tsirkel et al. ..... 345/207
2005/0057484 A1 * 3/2005 Diefenbaugh et al. ..... 345/102
2006/0025949 A1 * 2/2006 McCavit et al. ..... 702/85
2006/0092182 A1 * 5/2006 Diefenbaugh et al. ..... 345/690
2009/0192704 A1 * 7/2009 Geelen ..... 701/200
2010/0039414 A1 * 2/2010 Bell ..... 345/207
2010/0295873 A1 * 11/2010 Dodge et al. ..... 345/690

OTHER PUBLICATIONS

Hewlett-Packard Corporation, et al; Advanced Configuration and Power Interface Specification; book; Sep. 2, 2004; pp. 275-305; Revision 3.0.

* cited by examiner

*Primary Examiner* — Seokyun Moon

(57) ABSTRACT

A method of dynamically adjusting screen brightness is adapted for a screen to adjust the screen brightness. First, an original ambient light level and an original brightness adjustment factor are determined. Then, a relationship curve of an ambient light level and a brightness adjustment factor is determined. The current ambient light level is continuously monitored and compared with the original ambient light level to determine if the current ambient light level is equal to the original ambient light level. If not equal, a brightness adjustment factor corresponding to the current ambient light level is obtained based on the relationship curve, and the screen brightness is adjusted based on the brightness adjustment factor. The obtained screen brightness and the corresponding brightness adjustment factor are set to be the original screen brightness and the original brightness adjustment factor, and thus the background brightness is monitored again and the screen brightness is adjusted.

1 Claim, 4 Drawing Sheets

METHOD OF DYNAMICALLY ADJUSTING SCREEN BRIGHTNESS

CROSS-REFERENCE TO RELATED APPLICATIONS

This non-provisional application claims priority under 35 U.S.C. §119(a) on Patent Application No(s). 200710028181.9 filed in China on May 25, 2007, the entire contents of which are hereby incorporated by reference.

BACKGROUND OF THE INVENTION

1. Field of Invention

The present invention relates to a method of adjusting screen brightness, and more particularly a method of dynamically adjusting screen brightness.

2. Related Art

Since the sensibility of eyes of human beings to brightness changes with the variation of the ambient light level, the screens such as the cathode ray tube screens, liquid crystal screens, plasma screens on which the eyes are focused for a long period of time need to adjust the background brightness in accordance with the ambient light level. When the ambient light level rises, the screen brightness must be increased to fit the changes of sensibility of human eyes to brightness. Meanwhile, the increase of the screen brightness along with the ambient light level may enhance the difference between the screen brightness and the ambient light level, so as to prevent the background brightness of the screen being approximate to or lower than the ambient light level to cause the images on the screen are not easy to identify. On the contrary, when the ambient light level drops, the background brightness of the screen must be decreased simultaneously, so as to prevent the difference between the background brightness of the screen and ambient light level being too great to cause uncomfortable feeling to eyes of human beings focusing on the screens.

FIG. 1 shows a relationship curve of an ambient light level and a brightness adjustment factor in conventional art, which is used for the screen to automatically adjust the background brightness. In FIG. 1, the longitudinal axis is the ambient light level, and the transverse axis is the brightness adjustment factor (display luminance, %) of the screen brightness. In the conventional art, a reference point R is selected and the ambient light level of the reference point R is set to be an original ambient light level $Lux_{original}$. The corresponding brightness adjustment factor is set to be 100% to serve as a reference. Next, along the longitudinal axis, a longitudinal straight line passing the reference point R is selected to serve as a base line of the brightness adjustment factor. Screen are mostly used in offices, so the original ambient light level $Lux_{original}$ is generally set to be the office brightness, and meanwhile, an appropriate original screen brightness $BLK_{original}$ of the screen is also given to meet the original ambient light level $Lux_{original}$. Then, a plurality of ambient light levels is obtained and the corresponding screen brightness of the screen under each ambient light level is determined one by one. The screen brightness corresponding to each ambient light level is compared with the screen brightness corresponding to the original ambient light level, so as to obtain the brightness adjustment factors corresponding to all the screen brightness. A corresponding curve of each point is found in the relationship curve in FIG. 1, and this curve is the curve of the screen backlight adjustment factor.

The screen or the computer system for driving the screen uses an optical sensor to continuously monitor the ambient light level. When the ambient light level $Lux_{current}$ is changed to be a new ambient light level $Lux_{new}$, a brightness adjustment factor $Adj_{new}$ corresponding to the ambient light level $Lux_{new}$ is found, and the obtained brightness adjustment factor $Adj_{new}$ is multiplied by the current screen brightness $BLK_{current}$, thus obtaining a new ambient light level $BLK_{new}$ for the screen.

$$BLK_{new}=BLK_{current}\times Adj_{new}$$

For example, the original ambient light level $Lux_{original}$ is 300 LUX, and the screen brightness is 150 LUX. When the ambient light level is changed to $Lux_{new}$=85 LUX, the corresponding brightness adjustment factor $Adj_{new}$ is 80%. That is, the new screen brightness $BLK_{new}$ needs to be adjusted to 150×80%=120. Likewise, when the ambient light level is changed to $Lux_{new}$=1000 LUX, the corresponding brightness adjustment factor $Adj_{new}$ is 150%, the new screen brightness $BLK_{new}$ needs to be adjusted to 150×150%=225 LUX.

However, in the above adjustment method, the brightness adjustment factor is determined by a single and fixed base line, and the brightness adjustment factor corresponding to the original ambient light level is set to be 100% for adjustment. That is to say, the brightness adjustment factor Adj is calculated under the condition that the brightness adjustment factor Adj is the original screen brightness $BLK_{original}$, but the adjustment is made based on the current screen brightness $BLK_{current}$.

The current screen brightness $BLK_{current}$ will change along with the adjustment and does not always be the original screen brightness $BLK_{original}$. Thus, the current screen brightness $BLK_{current}$ will be distorted continuously after several adjustments based on the base line, which results in the background brightness does not fit the change of sensibility of eyes of human beings. For example, when the screen brightness is changed to 150 LUX after several adjustments, the corresponding ambient light level is 75 LUX. When the ambient light level rises to a new ambient light level $Lux_{new}$ of 85 LUX, the new screen brightness $BLK_{new}$ should be increased along with the new ambient light level $Lux_{new}$ in theory. However, in consideration of the base line serving as the reference for the adjustment, the corresponding brightness adjustment factor $Adj_{new}$ is actually 80%, such that the screen brightness after adjustment is $BLK_{new}=BLK_{current}\times Adj_{new}$, i.e., 150×80%=120. That is to say, the new screen brightness $BLK_{new}$ is decreased instead after the background brightness $LuX_{new}$ is increased, and thus the screen brightness becomes insufficient and the eyes of human beings cannot clearly see the images on the screen.

SUMMARY OF THE INVENTION

Accordingly, the present invention provides a method of dynamically adjusting screen brightness, so as to solve the problem that the screen brightness dose not meet the change of the background brightness since the adjustment reference is fixed in conventional art.

As embodied and broadly described herein, the present invention provides a method of dynamically adjusting screen brightness, adapted for a screen to adjust the screen brightness thereof, and includes the following steps. First, an original ambient light level and a corresponding original brightness adjustment factor are determined. Then, a relationship curve of an ambient light level and a brightness adjustment factor is determined. The current ambient light level is continuously monitored and compared with the original ambient light level to determine if the current ambient light level is equal to the original ambient light level. If not equal, a brightness adjustment factor corresponding to the current ambient light level is obtained based on the relationship curve, and the screen brightness is adjusted based on the brightness adjustment factor. The obtained screen brightness is set to be the original screen brightness, and the corresponding brightness adjustment factor is set to be the original brightness adjustment factor, and thus the background brightness is monitored again and the screen brightness is adjusted.

The advantages of the present invention lies in that, the adjustment reference parameters of the screen brightness are corrected and adjusted along with each adjustment of the screen brightness, such that the reference for the screen brightness adjustment is dynamically adjusted. Therefore, the correction of the screen brightness meets the change of the background brightness and is closest to the actually desired adjustment.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
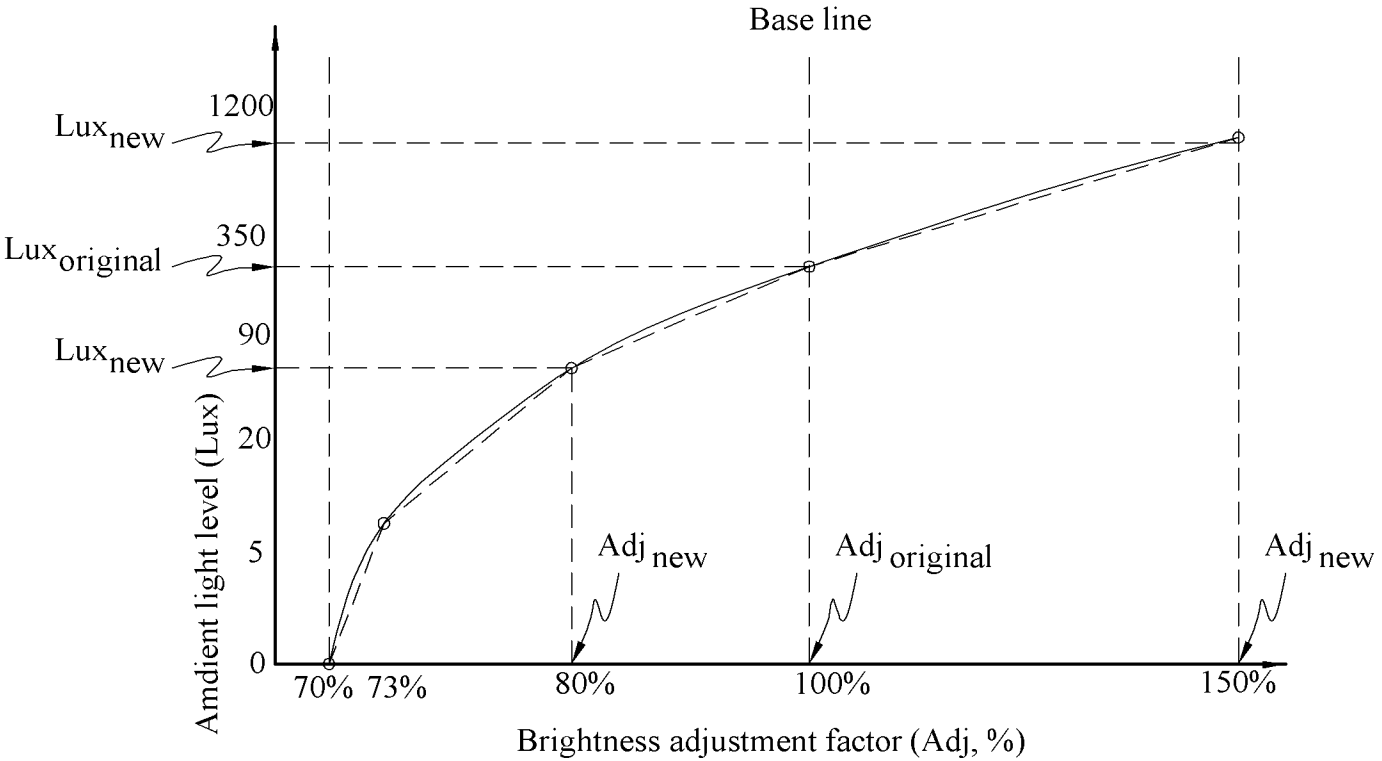
Fig.1 (conventional art)
FIG. 1 is a relationship curve of an ambient light level and a brightness adjustment factor in conventional art.
Figure 2:
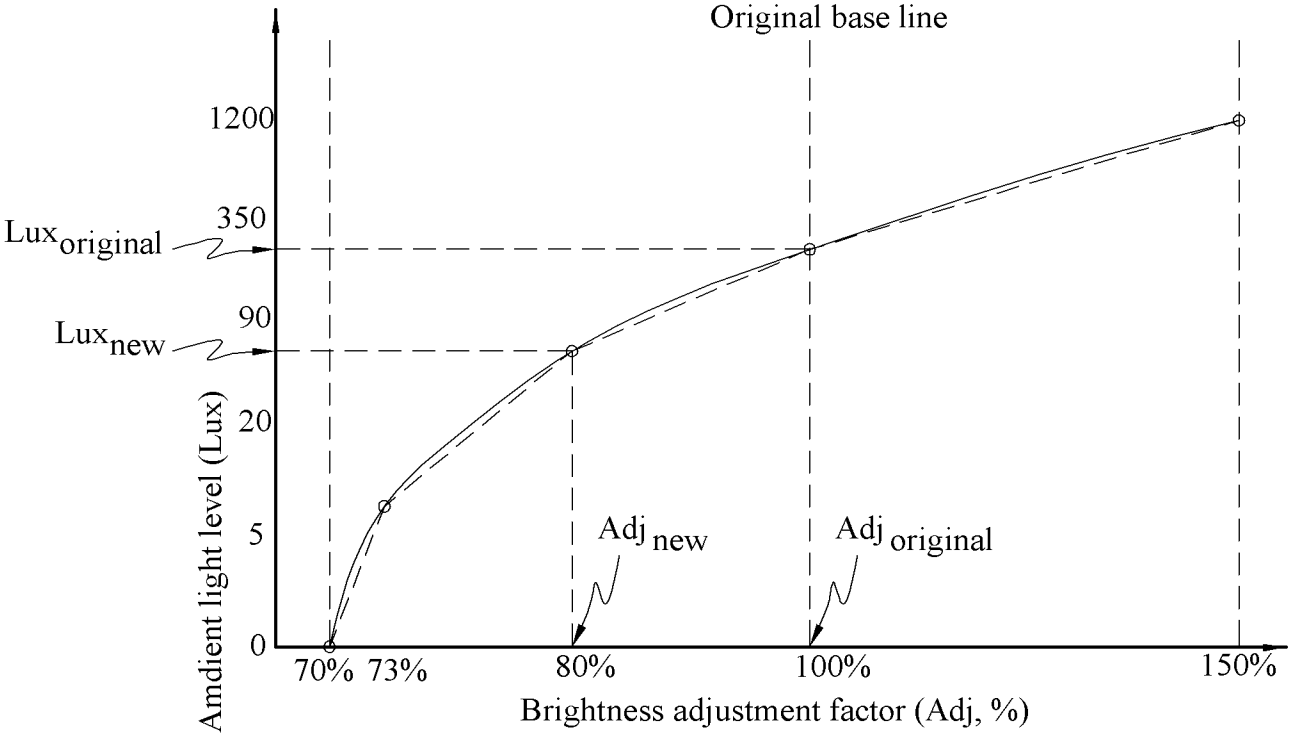
FIG. 2 is a relationship curve of an ambient light level and a brightness adjustment factor according to an embodiment of the present invention.
Figure 3:
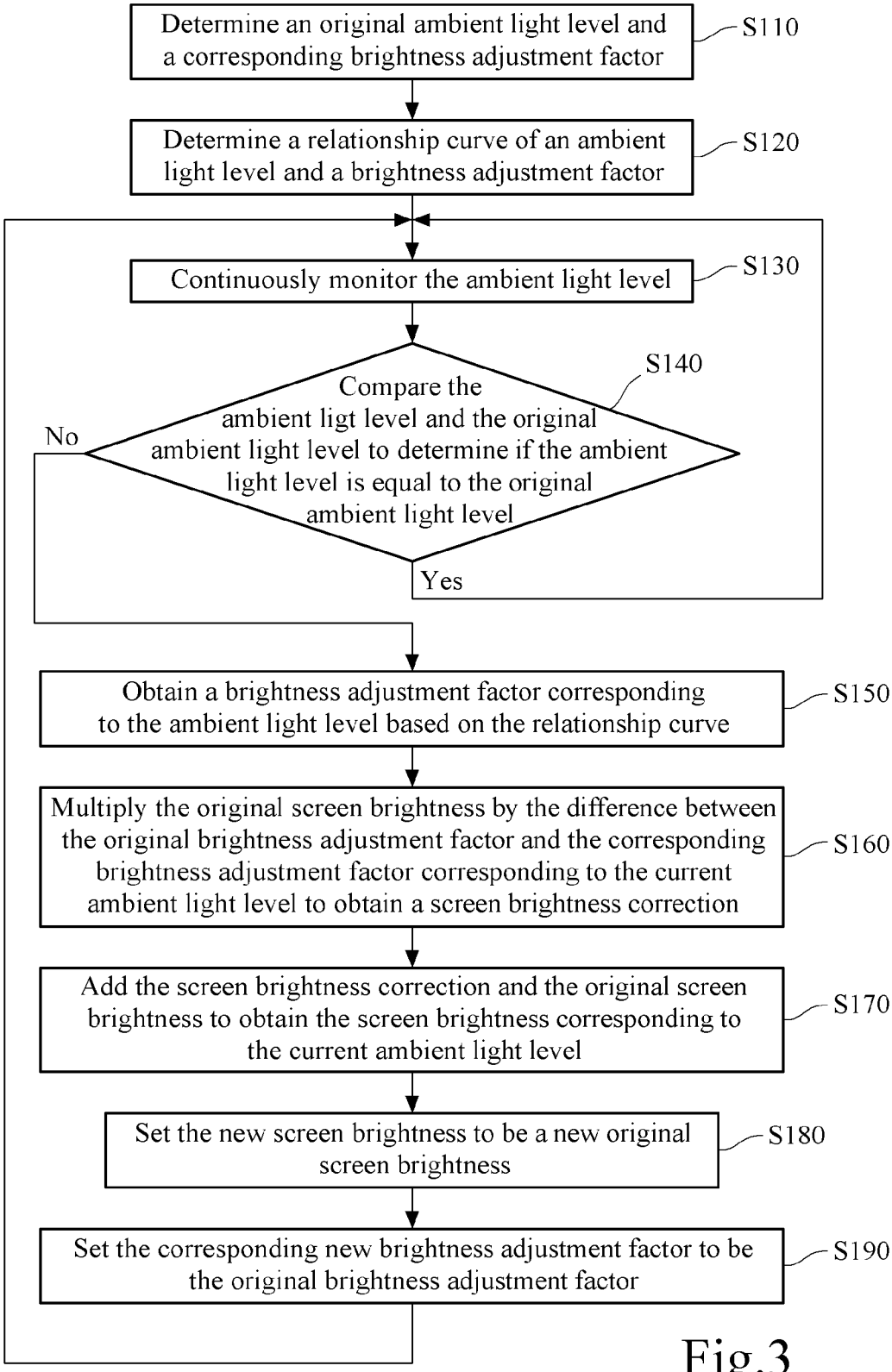
FIG. 3 is a flow chart according to an embodiment of the present invention.

Referring to FIGS. 2 and 3, a method of dynamically adjusting screen brightness according to an embodiment of the present invention is disclosed, which is adapted for a screen to automatically adjust the screen brightness to fit the sensibility of eyes of human beings. The method may be programmed into a controller of a screen, such that an ambient light level is obtained by an optical sensor, and is then transmitted to the controller, and the controller adjusts the backlight level or the background brightness according to the ambient light level, so as to change the screen brightness. Referring to FIGS. 2 and 3, the method of dynamically adjusting screen brightness includes the following steps. First, a relationship curve of the ambient light level and the brightness adjustment factor is determined (S120) by means of obtaining a plurality of ambient light levels Lux, and determining the screen brightness BLK corresponding to each ambient light level Lux respectively. The most commonly used ambient light level Lux is selected to be an original ambient light level $Lux_{original}$, the brightness adjustment factor Adj is set to be an original brightness adjustment factor $Adj_{original}$ (S110), and the value thereof may be set to 100%. The original ambient light level $BLK_{original}$ is taken as the reference value, and the screen brightness BLK corresponding to each ambient light level Lux is divided by the reference value to obtain the brightness adjustment factor Adj corresponding to the ambient light level BLK. The relationship curve is plotted with the ambient light levels Lux and the brightness adjustment factors Adj, taking the ambient light level Lux as the longitudinal axis, and the brightness adjustment factor Adj as the transverse axis (S120), as shown in FIG. 2, thereby acquiring the brightness adjustment factor Adj corresponding to different ambient light levels Lux. A straight line corresponding to a brightness adjustment factor of 100% is taken along the longitudinal axis to be used as an original base line for the adjustment of the screen brightness BLK.

Next, the ambient light level $Lux_{new}$ is continuously monitored (S130) and compared with the original ambient light level $Lux_{original}$ to determine if the ambient light level $Lux_{new}$ is equal to the original ambient light level $Lux_{original}$ (S140). If the ambient light level $Lux_{new}$ is equal to the original ambient light level $Lux_{original}$, the ambient light level $Lux_{new}$ is continuously monitored (S130). If the ambient light level Lux is not equal to the original ambient light level $Lux_{original}$, the screen brightness is adjusted.

When the ambient light level $Lux_{new}$ is not equal to the original ambient light level $Lux_{original}$, a brightness adjustment factor $Adj_{new}$ corresponding to the ambient light level $Lux_{new}$ is obtained based on the relationship curve (S150). Next, the original screen brightness $BLK_{original}$ is multiplied by the difference between the original brightness adjustment factor $Adj_{original}$ and the corresponding brightness adjustment factor $Adj_{new}$ to obtain a screen brightness correction (S160). The screen brightness correction is added with the original screen brightness $BLK_{original}$ to obtain the screen brightness $BLK_{new}$ corresponding to the current ambient light level $Lux_{new}$ (S170). The calculation formula of the screen brightness $BLK_{new}$ is expressed as follows:

$$BLK_{new}=BLK_{original}+BLK_{original}\times\{Adj_{new}-Adj_{original}\}$$

Figure 4:
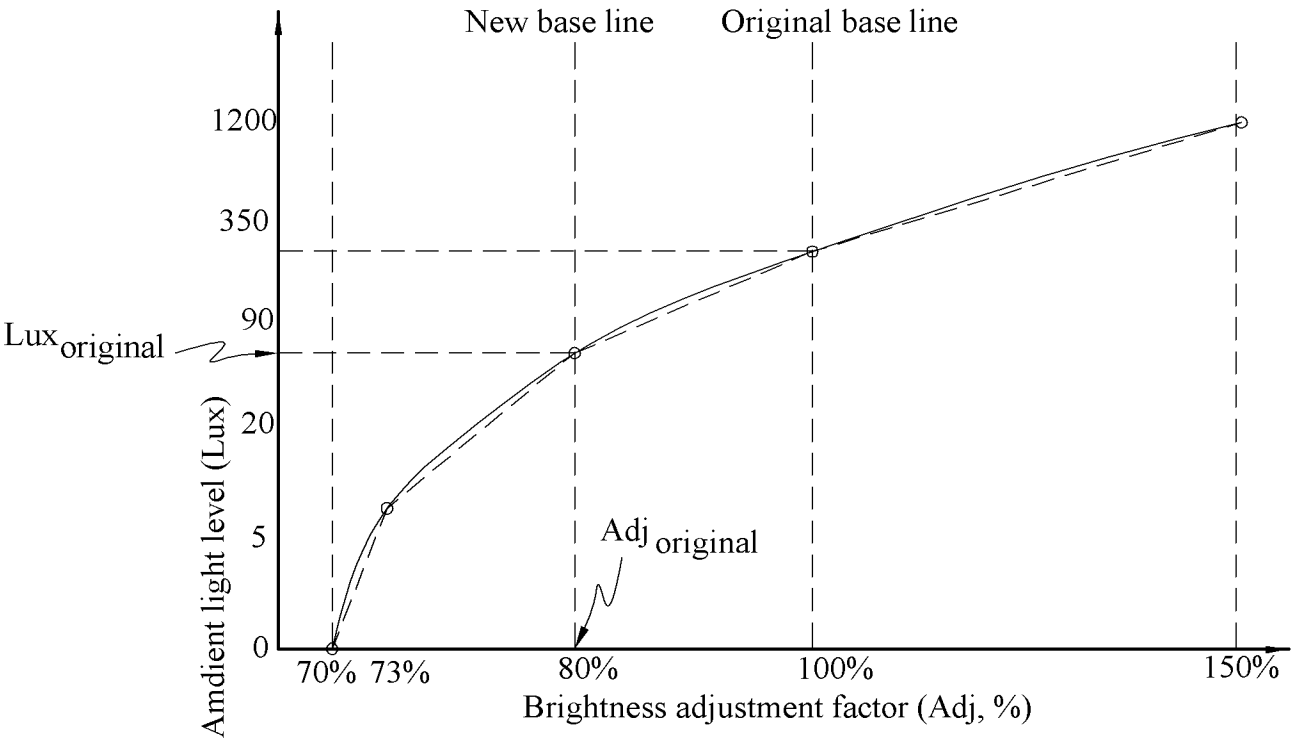
FIG. 4 is a relationship curve of the ambient light level and the brightness adjustment factor according to the embodiment of the present invention, which discloses that an original screen brightness, an original brightness adjustment factor, and an original background brightness changes along with the adjustment of the screen brightness.

Referring to FIGS. 3 and 4, then, the new screen brightness $BLK_{new}$ is set to be the original screen brightness $BLK_{original}$ (S180), and the corresponding new brightness adjustment factor $Adj_{new}$ is set to be the original brightness adjustment factor $Adj_{original}$ to serve as a new adjustment reference (S190). The straight line along the longitudinal axis passing through the new original brightness adjustment factor $Adj_{original}$ is the new base line.

The ambient light level $Lux_{new}$ is continuously monitored again (S130). When the ambient light level $Lux_{new}$ changes to be not equal to the obtained new original ambient light level $Lux_{original}$, the steps of obtaining the corresponding brightness adjustment factor $Adj_{new}$ and obtaining the screen brightness $BLK_{new}$ corresponding to the current ambient light level $Lux_{new}$ are repeated. Likewise, the obtained new screen brightness $BLK_{new}$ is set to be the original screen brightness $BLK_{original}$ (S180), and the corresponding new brightness adjustment factor $Adj_{new}$ is set to be the original brightness adjustment factor $Adj_{original}$ to serve as a new reference for the subsequent correction of the screen brightness.

According to the method of the present invention, the reference for the correction of the screen brightness includes the current screen brightness and the brightness adjustment factor, and is corrected and adjusted with each adjustment of the screen brightness, such that the reference is dynamically adjusted to meet the current screen brightness. Therefore, after each change of the ambient light level, the correction of the screen brightness is closest to the actually desired adjustment.

What is claimed is:

1. A method of dynamically adjusting screen brightness, adapted for a screen to adjust the screen brightness thereof, comprising:

(A) determining a relationship curve of an ambient light level and a brightness adjustment by obtaining a plurality of ambient light levels and determining a screen brightness corresponding to each ambient light level respectively;

(B) determining an original ambient light level having a corresponding original screen brightness and original brightness adjustment factor based on the relationship curve, wherein the original brightness adjustment factor defines an original baseline for adjusting screen brightness;

(C) continuously monitoring a current ambient light level, and comparing the current ambient light level and the original ambient light level to determine if the current ambient light level is equal to the original ambient light level;

(D-1) when the current ambient light level is not equal to the original ambient light level, calculating an original screen brightness correction using the original baseline by obtaining the difference between the original brightness adjustment factor and a brightness adjustment factor of the current ambient light level based on the relationship curve, and multiplying the difference by the original screen brightness;

(D-2) adjusting screen brightness by adding the original screen brightness correction calculated in step (D-1) to the original screen brightness to obtain a new screen brightness;

(E) defining a new baseline for adjusting screen brightness by setting the new screen brightness to be the original screen brightness, the current ambient level to be the original ambient light level, and the corresponding brightness adjustment factor to be the original brightness adjustment factor;

(F) continuously monitoring the ambient light level again;

(G) when the current ambient light level changes to be not equal to the original ambient light level set in step (E), calculating a new screen brightness correction using the new baseline by multiplying the original screen brightness set in step (E) by a difference between the original brightness adjustment factor set in step (E) and a brightness adjustment factor corresponding to the current ambient light level; and (H) adjusting screen brightness by adding the new screen brightness correction and the original screen brightness set in step (E) to obtain a screen brightness corresponding to the current ambient light level, so as to adjust the screen brightness of the screen.

* * * * *